United States Patent [19]

Wirt

[11] 4,029,225

[45] June 14, 1977

[54] BOOM-STICK ADAPTER FOR TWO-PIECE BOOM

[75] Inventor: Leon A. Wirt, Joliet, Ill.

[73] Assignee: Caterpillar Tractor Co., Peoria, Ill.

[22] Filed: Apr. 16, 1976

[21] Appl. No.: 677,575

[52] U.S. Cl. ..... 214/138 R; 214/141

[51] Int. Cl.[2] ..... E02F 3/32

[58] Field of Search ..... 214/138 R, 141; 212/54, 212/55, 58, 59, 144

[56] References Cited

UNITED STATES PATENTS

| | | | |
|---|---|---|---|
| 3,358,859 | 12/1967 | Przybylski | 214/138 R |
| 3,977,148 | 8/1976 | Ranini | 214/141 |

FOREIGN PATENTS OR APPLICATIONS

| | | | |
|---|---|---|---|
| 2,154,724 | 5/1973 | Germany | 214/138 R |
| 2,163,358 | 7/1973 | Germany | 214/138 R |

*Primary Examiner*—Robert J. Spar
*Assistant Examiner*—Ross Weaver
*Attorney, Agent, or Firm*—Wegner, Stellman, McCord, Wiles & Wood

[57] ABSTRACT

A material handling apparatus having a stub boom provided with structure for connecting a fore boom thereto to form a two-piece boom, structure for selectively swingably positioning the stub boom, a work implement, and an improved joint structure for swingably connecting the work implement to the stub boom. The improved joint is defined by an adapter having a mounting portion and a joint portion swingably interconnected. Mounting structure is provided for cooperating with the stub boom connecting structure for mounting the adapter mounting portion to the stub boom, and mounting structure is provided for mounting the work implement to the joint portion of the adapter. A positioner is provided for selectively swingably positioning the joint portion of the adapter for correspondingly selectively positioning the work implement.

9 Claims, 6 Drawing Figures

BOOM-STICK ADAPTER FOR TWO-PIECE BOOM

BACKGROUND OF THE INVENTION

1. Field of the Invention

This invention relates to material handling apparatus and in particular to means for connecting work implements to a boom portion of an excavator or the like.

2. Description of the Prior Art

One form of work implement which may be selectively mounted to the boom of a tractor-type vehicle comprises a tree harvester, sometimes referred to as a shear, or feller/buncher.

The conventional two-piece boom provided with such vehicles has provided a suitable means for mounting the stick carrying at its distal end the work implement, such as the tree harvester means. The stick is connected to the fore boom of a two-piece boom structure with the fore boom being swingably carried by a stub, or lower, boom portion of the boom structure.

While the previous designs have provided facilitated handling of work elements, such as tree harvesters, there has been some limitation on the retractivity and movability of the prior art structures.

SUMMARY OF THE INVENTION

The present invention comprehends an improved material handling apparatus wherein a work implement is swingably carried on a boom structure of the apparatus providing increased retractive capability and movability over the structures of the prior art. The material handling apparatus of the present invention provides increased versatility and productivity in the use thereof.

More specifically, the present invention comprehends such a material handling apparatus wherein new and improved joint means are provided for swingably connecting the work implement to the stub portion of the boom. The invention comprehends utilizing a portion of the means for connecting a fore boom to the stub boom as means for connecting the joint means thereto.

The joint means may comprise an adapter having a mounting portion and a joint portion. The mounting portion may be mounted to the stub boom by first mounting means cooperating with the stub boom connecting means. The joint portion of the adapter may be mounted to the mounting portion by second mounting means. The work element may be mounted to the joint portion of the adapter by third mounting means. Positioning means may be provided for selectively swingably positioning the joint portion and thereby effectively positioning the work element.

The work element may include a stick portion which may be connected to the adapter joint portion by the third mounting means. In the illustrated embodiment, the stick is fixedly secured to the joint portion of the adapter and the adapter is swingably connected to the mounting portion of the adapter.

The positioning means may comprise extensible means carried by the boom stub portion and articulated to the joint portion of the adapter.

In the illustrated embodiment, the mounting portion comprises a fabricated box section joint. The joint portion comprises a pair of spaced side plates joined by transversely extending stiffenerplates. The side plates are provided with aligned holes and a plurality of pins are provided for effecting connections between the joint portion and the mounting portion, stick, and extensible positioning means.

The improved articulation of the joint means maximizes the work area from a given position of the apparatus.

The improved joint means provides facilitated conversion of a two-piece boom structures to a relatively compact mounting arrangement for use with work implements, such as tree harvesters.

The improved joint means provides improved structural integrity having high strength and reliability. In means provides a relatively lightweight structure for further facilitated material handling operation.

Thus, the material handling apparatus of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
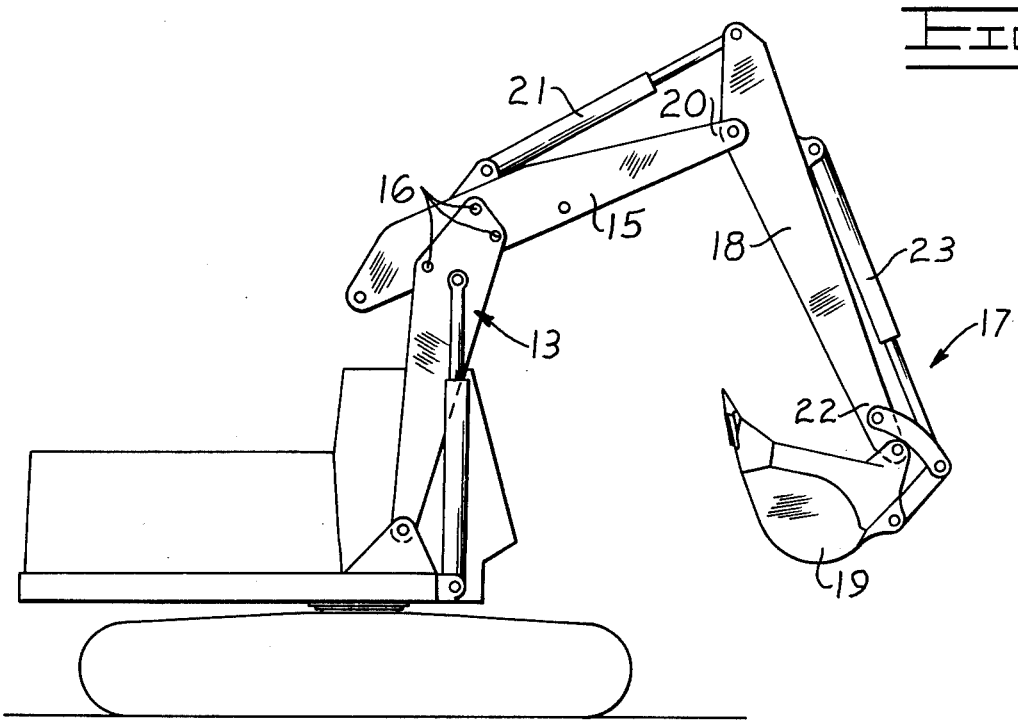
FIG. 1 is a side elevation of a material handling apparatus of the prior art.

In the exemplary embodiment of the invention as disclosed in the drawing, a material handling apparatus generally designated 10 is shown to include a tractor-type vehicle generally designated 11 having a frame 12 carrying a stub boom 13 articulated to a positioning cylinder 14.

Figure 2:
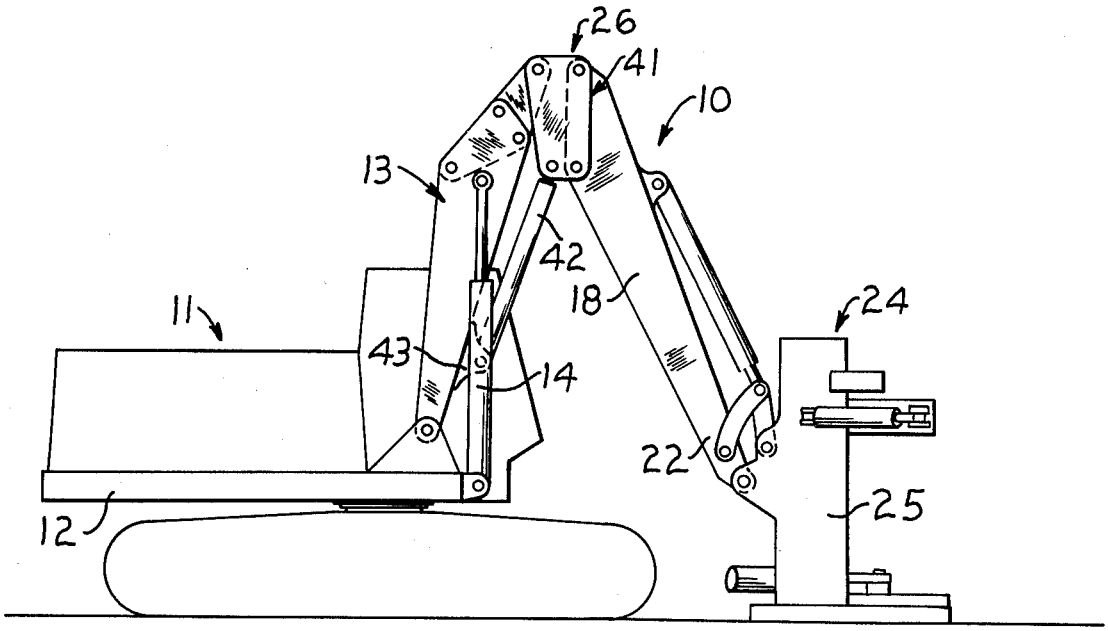
FIG. 2 is a side elevation of a material handling apparatus of the present invention.

As illustrated in FIG. 1, an arrangement commonly used in the prior art in connection with such material handling apparatuses, is to provide, in association with the stub boom 13, a fore boom 15 which is fixedly associated with the stub boom by a plurality of mounting pins 16. The assembly of the stub boom 13 and fore boom 15 comprises a two-piece boom which is adapted to carry any one of a plurality of different work implements. In the illustration of FIG. 1, the work implement comprises a bucket structure generally designated 17 including a stick 18 carrying at its distal end a bucket 19. The stick 18 is swingably mounted to the distal end 20 of the fore boom 15 and is adjustably positioned by means of a second cylinder 21. The bucket 19 is swingably connected to the distal end 22 of the stick 18 and is swingably positioned by a third cylinder 23.

Where the work element comprises a tree harvester, such as tree harvester 24 illustrated in FIG. 2, the bucket 19 is replaced with a harvesting apparatus 25. As shown in FIG. 2, the harvesting apparatus 25 is connected to the distal end 22 of the stick 18 in a manner similar to the connection of the bucket 19 in the prior art structure of FIG. 1.

As indicated briefly above, the present invention comprehends an improved joint means generally designated 26 for connecting the work implement, or tree harvester, 24 to the stub boom 13 in lieu of the fore boom 15 of the prior art structure.

Joint means 26 may be best seen with reference to FIGS. 3-6 of the drawing. More specifically as shown therein, distal end 27 of the stub boom comprises a bifurcated end defined by a pair of distal walls 28 and 29, wall 29 being broken away in FIG. 3 to facilitate illustration of the stub boom end structure.

Wall 28 is provided with three triangularly spaced holes 30, 31 and 32. Wall 29 is provided with corresponding holes aligned with holes 30, 31 and 32. A transverse wall 33 may be provided extending between the end walls 28 and 29 to provide a stiffened structure thereto. As further shown in FIG. 3, the piston connecting rod 34 of the cylinder 14 may be connected to a pin 35 for swingably connecting the positioning means to the stub boom.

Figure 3:
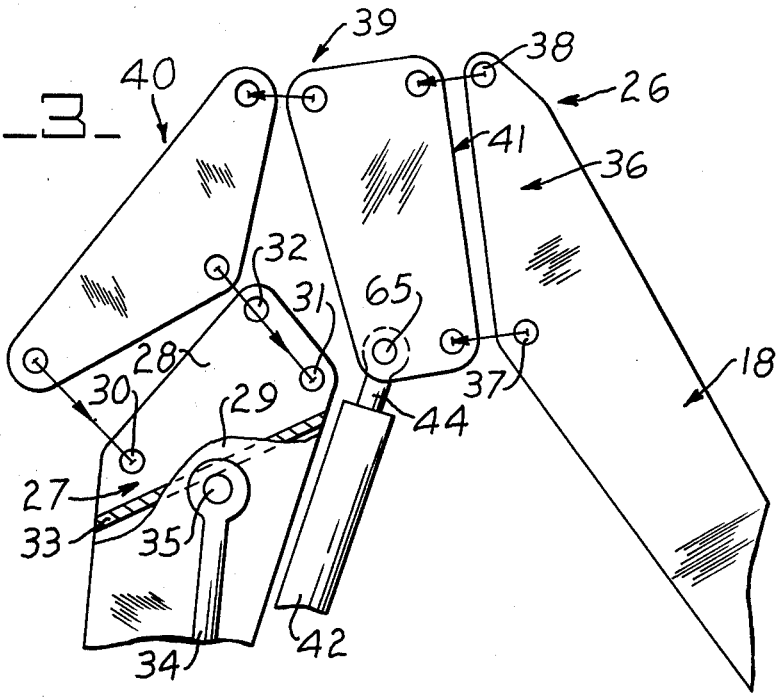
FIG. 3 is a fragmentary exploded side elevation of the joint means of the material handling apparatus.

As further shown in FIG. 3, stick 18 includes an upper end portion 36 provided with a pair of holes 37 and 38.

Joint means 26 includes an adapter 39 having a mounting portion 40 and a joint portion 41. Mounting portion 40 is arranged to be secured to the distal end 27 and joint portion 41 is adapted to be secured to the upper end 36 of the stick 18. The mounting and joint portions, in turn, are adapted to be swingably interconnected whereby a second positioning cylinder 42 pivotably mounted to the stub boom 13 by a pivot 43 may have its piston connecting rod 44 connected to the joint portion 41 for selectively positioning the work element as discussed above.

Figure 4:
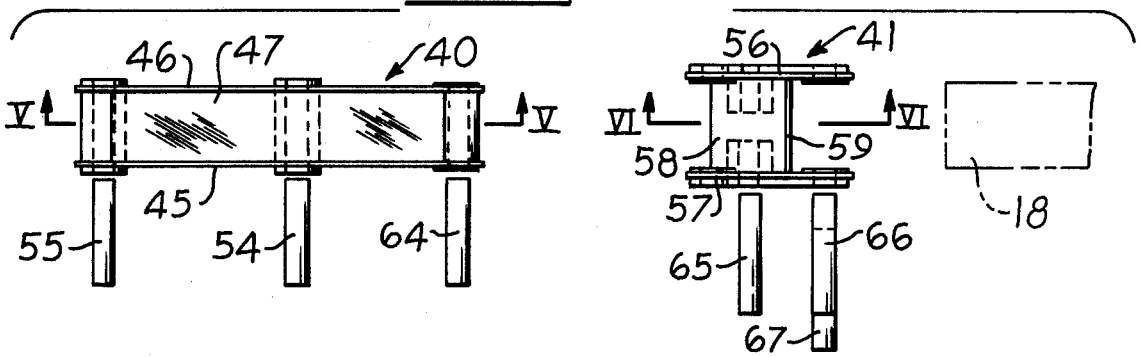
FIG. 4 is a fragmentary exploded plan view thereof.
Figure 5:
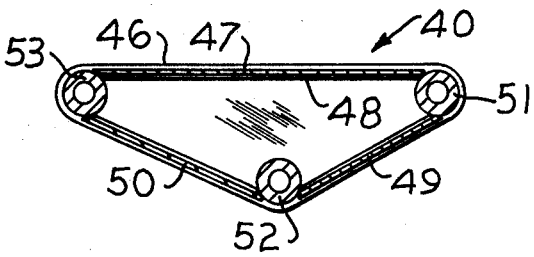
FIG. 5 is a vertical section taken substantially along the line 5—5 of FIG. 4.

More specifically, as shown in FIGS. 4 and 5, mounting portion 40 of the adapter 39 comprises a generally triangularly shaped, fabricated box section joint. The joint includes a pair of side walls 45 and 46, and a transverse enclosure wall 47. The enclosure wall is defined by a plurality of plates 48, 49 and 50 interconnected by tubular elements 51, 52 and 53. The plates 48, 49 and 50 may be secured to the tubular elements 51, 52 and 53 by suitable means, such as welding. The tubular elements, in turn, are positioned to be aligned with the holes 30 and 31 of the walls 28 and 29 of the stub boom end 27. Pins 54 and 55 are provided to be received in tubular portions 52 and 53 and holes 30 and 31 for fixedly securing the mounting portion 40 to the distal end 27 of the stub boom.

Figure 6:
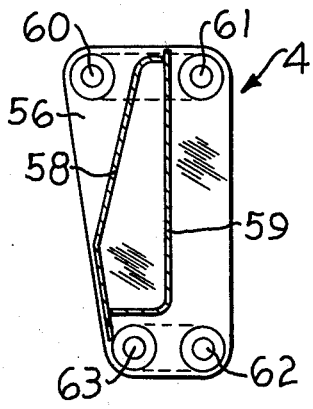
FIG. 6 is a vertical section taken substantially along the line 6—6 of FIG. 4.

As shown in FIGS. 4 and 6, the joint portion 41 of adapter 39 is defined by a pair of side walls 56 and 57 and a pair of transversely extending stiffener plates 58 and 59. Each of the side walls 56 and 57 is provided with a plurality of sockets holes 60, 61, 62 and 63.

The side plates 56 and 57 are adapted to straddle mounting portion 40 of the adapter so as to align socket hole 60 thereof with the tubular portion 51 of the mounting portion. A pin 64 is provided to extend through socket hole 60 and tubular portion 51 to swingably connect the joint portion 41 to the mounting portion 40 of the adapter.

A pin 65 may be provided to extend through socket hole 63 for pivotably connecting positioning means connector 44 of cylinder 42 to the joint portion 41.

Pins 66 and 67 are provided for extension through holes 37 and 38 of stick end 36 socket holes 61 and 62 of the adapter joint portion for fixedly securing the end 36 of the stick to the joint portion 41 of the adapter.

Thus, in the improved joint means 26 of the present invention, the fore boom 15 of the prior art structure has been replaced by an improved compact structural arrangement. The joint portion 41 of the improved joint means is swingably positioned by the cylinder 42 mounted to the stub boom 13 for further improved control of the work implement 24.

The joint means 26 may be readily installed in conjunction with the existing stub boom and work implement stick of the prior art while yet providing the improved facilitated control of the work implement in the material handling apparatus. The improved articulation provided by the joint means 26 provides increased retractive capability of the apparatus by permitting both minimum and maximum radial placement and use of the work implement.

The simplified structure of the mounting portion 40 and joint portion 41 provides high integrity, strength and reliability while at the same time effectively minimizing the weight of the joint means for facilitated mounting of the structure in the material handling apparatus.

The foregoing disclosure of specific embodiments is illustrative of the broad inventive concepts comprehended by the invention.

I claim:

1. In a material handling apparatus having a stub boom provided with means for connecting a fore boom thereto to form a two-piece boom, means for selectively swingably positioning the stub boom about a first axis, and a work implement, an improved joint means for swingably connecting the work element to said stub boom comprising: an adapter having a mounting portion and a joint portion; first mounting means cooperating with said stub boom connecting means for mounting said adapter mounting portion to said stub boom; second mounting means swingably mounting said adapter joint portion to said mounting portion to pivot about an axis parallel to said first axis; third mounting means fixedly mounting said work element to said adapter joint portion; and positioning means mounted to said stub boom and connected to said adapter joint portion for selectively swingably positioning said portion relative to said mounting portion for selectively positioning the work element.

2. The material handling apparatus of claim 1 wherein said work element includes a stick member and a work implement carried by the stick, said third mounting means mounting said stick member of said work element to said adapter joint portion.

3. The material handling apparatus of claim 1 wherein said third mounting means comprises means fixedly mounting said work element to said adapter joint portion.

4. The material handling apparatus of claim 1 wherein said first mounting means comprises means fixedly mounting said adapter mounting portion to said stub boom.

5. The material handling apparatus of claim 1 wherein said stub boom defines a bifurcated distal end and said mounting portion comprises a box member secured to said stub boom in said bifurcated end.

6. The material handling apparatus of claim 1 wherein said joint portion comprises a pair of spaced side plates and transversely extending stiffener plates.

7. The material handling apparatus of claim 1 wherein said joint portion comprises a pair of spaced side plates and transversely extending stiffener plates, said side plates being provided with aligned holes receiving a plurality of pins defining portions of said second and third mounting means.

8. The material handling apparatus of claim 1 wherein said joint portion comprises a pair of spaced side plates and transversely extending stiffener plates, said side plates being provided with aligned holes receiving a pin defining means connecting said positioning means to said joint portion for positioning the work element.

9. The material handling apparatus of claim 1 wherein said apparatus includes a vehicle and said work implement comprises a tree harvester.

* * * * *

UNITED STATES PATENT AND TRADEMARK OFFICE

CERTIFICATE OF CORRECTION

PATENT NO. : 4,029,225

DATED : June 14, 1977

INVENTOR(S) : Leon A. Wirt

It is certified that error appears in the above-identified patent and that said Letters Patent are hereby corrected as shown below:

Column 2, line 7, cancel "structures" and substitute therefor --structure--.

Column 2, line 11, after "In" insert the following omitted material: --addition to providing a compact arrangement, the improved joint--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*